United States Patent [19]

Johnson

[11] Patent Number: 4,528,765

[45] Date of Patent: Jul. 16, 1985

[54] EXTERNALLY VISIBLE SAFETY DEVICE FOR FIREARMS

[75] Inventor: David A. Johnson, Salem, Oreg.

[73] Assignee: J.F.S., Inc., Salem, Oreg.

[21] Appl. No.: 572,745

[22] Filed: Jan. 23, 1984

[51] Int. Cl.[3] ..... F41C 27/00; F41C 17/00

[52] U.S. Cl. ..... 42/1 LP; 42/70 R

[58] Field of Search ..... 42/1 LP, 70 R

[56] References Cited

U.S. PATENT DOCUMENTS

| | | | |
|---|---|---|---|
| 2,997,802 | 8/1961 | Robbins | 42/1 LP |
| 3,089,272 | 5/1963 | McKinlay | 42/1 LP |
| 3,605,311 | 9/1971 | Hermann | 42/1 LP |
| 4,384,420 | 5/1983 | Von Muller | 42/1 LP |

*Primary Examiner*—Charles T. Jordan

*Attorney, Agent, or Firm*—Chernoff, Vilhauer, McClung, Birdwell & Stenzel

[57] ABSTRACT

A safety device for use with a repeating firearm having a magazine well for holding a box-like removable magazine, to prevent the firearm from being unintentionally fired and for providing an indication visible at some distance that the firearm is in such a safe condition. A plug having a body whose dimensions correspond with those of a portion of a magazine for such a weapon includes flanges to close the magazine-receiving opening of the magazine well, a top portion which extends from the magazine well into the space which is occupied by the bolt of the weapon when the bolt is in a position closing the breech of the firing chamber of the weapon, and a member which holds a bolt latch in a position locking the bolt open. The body includes a detent for interacting with a magazine retention latch of the firearm to retain the safety device within the magazine well, with a portion of the device being visible externally as an indication that the safety device is operatively installed in the weapon. Visible exposure of more than a predetermined portion of the safety device provides an indication that the safety device is not properly installed in the weapon and that the weapon is not in a safe condition.

16 Claims, 8 Drawing Figures

FIG. 1
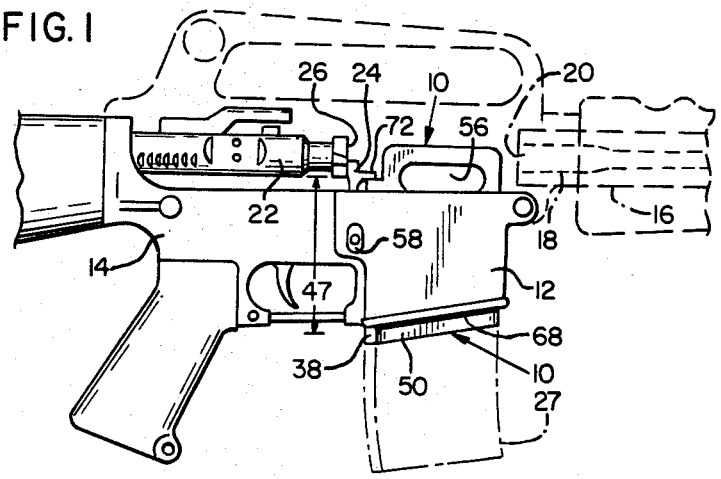
FIG. 4
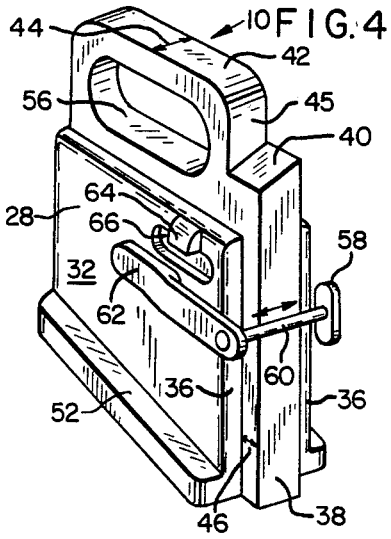
FIG. 2
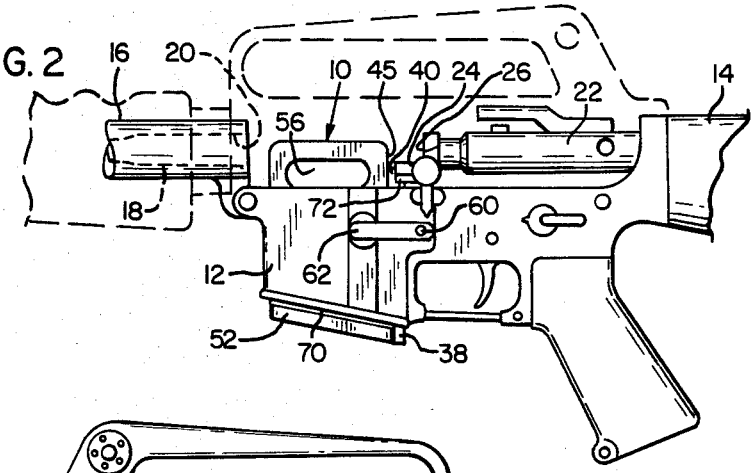
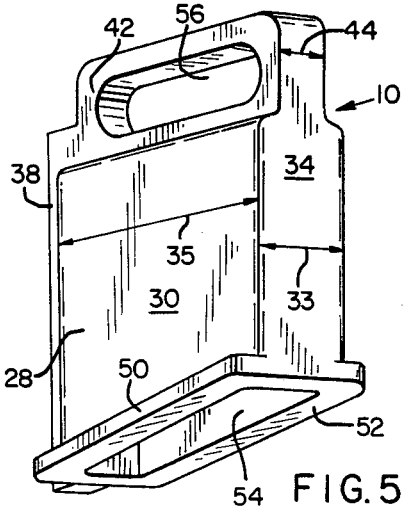
FIG. 5
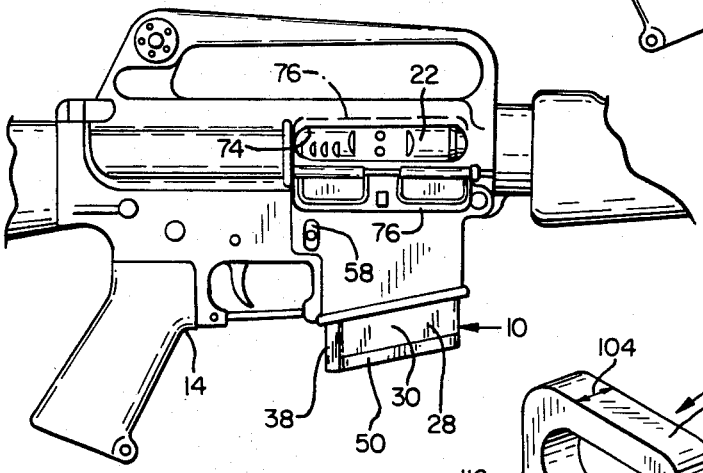
FIG. 7
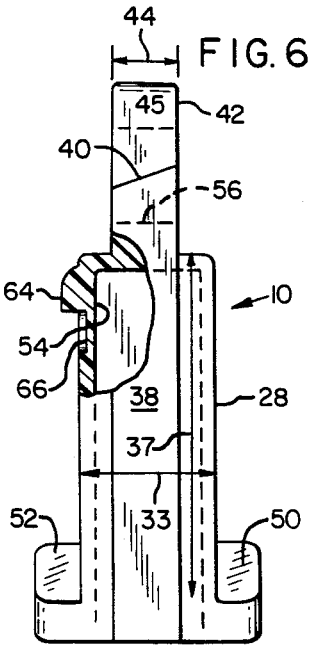
FIG. 6
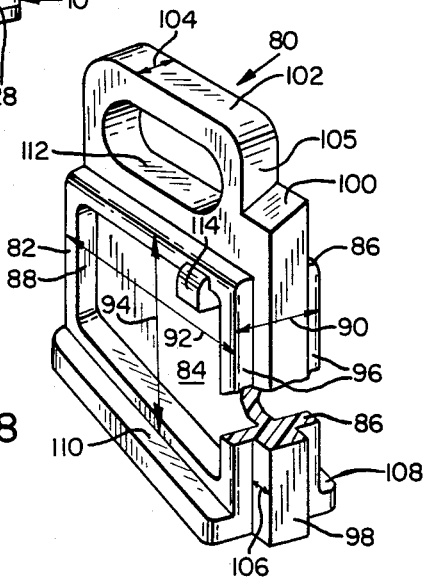
FIG. 8

EXTERNALLY VISIBLE SAFETY DEVICE FOR FIREARMS

BACKGROUND OF THE INVENTION

The present invention relates to firearms, and particularly to a safety device for use in connection with repeating firearms utilizing box-like removable magazines.

Many repeating firearms utilize replaceable magazines which, when in place in such a firearm, exclude dirt, sand, and the like from entering internal mechanisms and doing damage or causing failure of the firearm to operate properly. When the replaceable magazine is not in place in such a weapon, however, the loading mechanism and other movable parts of the weapon are exposed to contamination by material carried by the air or otherwise found in the immediate environment.

Some firearms, particularly automatic firearms such as the self-loading M-16 rifle used by the Armed Forces of the United States, have ejection ports through which empty cartridge cases are ejected upon firing of the weapon. Although the ejection port in many self-loading weapons is another potential point of entry for contaminants into the working mechanisms of the weapon, the M-16 rifle is equipped with a hinge-mounted cover which may be closed to protect the internal mechanisms of the rifle against such contamination. Thus the M-16 rifle, when a magazine is in place and the ejection port cover is closed, is relatively well-protected against contamination.

Safety is of prime importance in conducting military training exercises. For the sake of safety, however, soldiers have been permitted to carry an M-16 rifle during some military training exercises only with the magazine removed, the ejection port cover open, and the bolt withdrawn rearwardly to an open position exposing the breech of the firing chamber, so that it could be clearly seen that the weapon was unloaded and not able to be fired, either accidentally or otherwise.

While use of the M-16 in such training exercises was thereby made safe, the working mechanisms of the rifle were thereby exposed to possible contamination. Particularly when these requirements for the sake of safety were carried out during exercises performed in desert sand conditions, the weapons were exposed to entry of contaminating materials which caused a significant number of the weapons to malfunction in later use, unless internal working mechanisms of the weapons were carefully cleaned first. Such cleaning requires an undesirably long time for readying such basic infantry weapons for service use after their use in training exercises.

It is necessary to be able to carry out training exercises safely, but without excessive risk of damage to weapons, and without requiring an unduly long period of time to make weapons ready for actual use thereafter.

Not only is it desirable for weapons to be in a safe condition during military training exercises, but it is also desirable that such a safe condition should be easily and quickly verifiable from a distance of at least several meters, so that it is quickly obvious to a commander if any of his men's weapons have not been properly made safe.

While a weapon may be made safe by removal of an essential part such as a firing pin, such a procedure has two problems. First, it may be difficult to verify that the procedure has been actually carried out and that the weapon is no longer capable of being fired. Second, there is a risk of damage or loss of a part which has been removed from its proper location, so that it would be difficult or impossible to restore the weapon to its normal useful condition.

Prior efforts to provide a way to make a firearm safe from accidental firing without disassembly of the weapon include a chamber plugging device shown in Robbins U.S. Pat. No. 2,997,802. Robbins discloses a device usable particularly in a bolt action rifle to plug the firing chamber and interfere with closure of the bolt of such a weapon. The Robbins device, however, has no provision for preventing entry of contamination through a magazine well of an automatic-loading weapon from which a magazine has been removed as a safety measure.

McKinlay U.S. Pat. No. 3,089,272 and Hermann U.S. Pat. No. 3,605,311 disclose key-locked devices which fit inside the receivers of automatic-loading shotguns and similar automatic-loading weapons. The devices close the empty case ejection port and prevent the bolt from closing the breech of such a weapon. The McKinlay and Hermann disclosures, however, make no provision for protecting the working mechanisms which may be exposed upon removal of a box-like magazine from automatic-loading weapons. Additionally, the McKinlay and Hermann devices would seem to be clearly visible only from the ejection port side of weapons in which they are installed.

What is needed, then, is a device which will positively prevent a weapon, particularly an automatic-loading weapon such as a military rifle, from being fired accidentally, and which will make it easily verifiable visually, from a considerable distance away from the weapon, that the weapon is incapable of being fired. Such a device ideally should be straightforward, inexpensive, and easy to use, should allow the weapon to be made safe without thereby exposing internal working parts to contamination, and should leave the weapon quickly able to be made reliably ready for firing without disassembly and cleaning.

SUMMARY OF THE INVENTION

The present invention overcomes the shortcomings and disadvantages of the prior art devices and meets the need for a reliable device for making automatic-loading rifles safe for non-firing use in military training exercises, by providing a lightweight, easily visible, and positively acting safety plug which fits into the magazine well of an automatic-loading weapon in place of the normal magazine and prevents firing, while excluding dirt from the internal mechanisms of the weapon. The safety device of the present invention is held in place by the latch which normally is used to retain a magazine in such a weapon. When the safety device of the present invention is in place it prevents release of a latch included in the weapon to hold the breech bolt of the weapon securely in a rearwardly located, open position. Additionally, inserting the device of the present invention interposes a physical obstruction between the bolt and the breech opening of such a rifle, preventing insertion of a cartridge into the firing chamber and preventing the bolt from closing the breech so that a cartridge could be fired, even if it were already located in the firing chamber.

The safety device of the present invention includes flanges which rest against the outer edges of the magazine well into which it is placed, to prevent entry of dust and grit. Preferably, the safety device is made of a conspicuously brightly colored material, so that the flanges are clearly visible from some distance on either side of a weapon in which the safety device is in place.

Because a portion of the safety device normally extends upwardly between the front of the bolt and the breech opening of the firing chamber, the safety device cannot be inserted fully into a weapon when the bolt is closed. The safety device will not remain in place only partly inserted; furthermore, a significantly larger portion of the device is clearly visible outside the weapon when the device is only partly inserted, making its improper insertion immediately apparent.

Because the safety device of the invention positively prevents a cartridge from being fired, even if the cartridge is located within the firing chamber of the weapon, and because the device can be fully inserted into its place in the magazine well of the weapon only when the bolt is in its rearwardly withdrawn, open position, the ejection port cover of a weapon such as an M-16 rifle need not be left open to verify that the weapon has been made safe. Instead, the ejection port cover may be closed to protect the working mechanisms of the weapon from contamination.

It is therefore a principal objective of the present invention to provide a positively acting safety device whose proper use can be visually verified quickly and positively.

It is another important objective of the present invention to provide a safety device for military weapons which protects the internal moving mechanisms of such weapons against entry of dirt or sand.

It is an important feature of the safety device of the present invention that it includes a flange which remains outside the magazine well of an automatic-loading rifle in which the safety device of the present invention is used, in order to provide an indication, clearly visible from either side of the weapon, that the weapon is safe.

It is another important feature of the safety device of the present invention that it includes a pad which positively secures a bolt latch when the safety device is in place, thus preventing the bolt from being closed.

It is yet a further feature of the safety device of the present invention that it has a top portion which prevents insertion of the safety device into a weapon unless the bolt of the weapon is first fully withdrawn from the breech of the firing chamber to an open position.

It is an important advantage of the safety device of the present invention that it better protects the internal mechanisms of an automatic-loading weapon with which it is used from intrusion of foreign matter than was possible with previously known safety devices for such weapons.

It is another important advantage of the safety device of the present invention that it makes it possible to verify that a weapon is in a safe condition, visually from a greater distance than previously was possible.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a right side elevational view of part of an M-16 or similar rifle in which a safety device embodying the present invention is installed, preventing the rifle from being fired.

FIG. 2 is a left side elevational view of the safety device and portion of a rifle shown in FIG. 1.

FIG. 4 is a perspective view, at an enlarged scale, of the safety device shown in FIG. 1, taken from the upper left rear.

FIG. 5 is a perspective view, at an enlarged scale, of the safety device shown in FIG. 1, taken from the lower right front.

FIG. 6 is a partially cut-away rear elevational view, at an enlarged scale, of the safety device shown in FIG. 1.

FIG. 7 is a right side elevational view of the portion of a rifle and the safety device shown in FIG. 1, with the bolt of the rifle in a forward, closed position preventing the safety device from being inserted fully into the magazine well of the rifle.

FIG. 8 is a perspective view, partially cut away for clarity, of an alternative form of the safety device shown in FIG. 1.

DETAILED DESCRIPTION OF THE INVENTION

Figure 3:
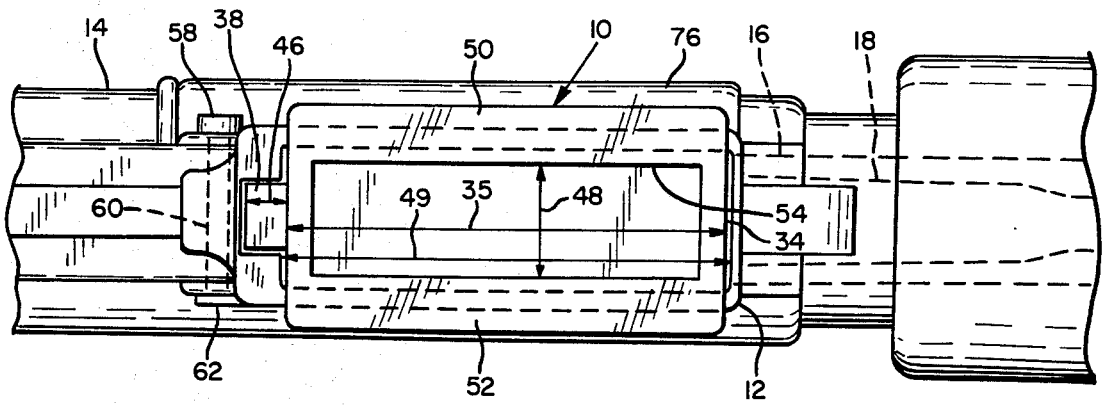
FIG. 3 is a bottom plan view of the safety device and portion of a rifle shown in FIG. 1.

Referring first to FIGS. 1–3 of the drawings, a safety device 10 embodying the present invention is shown in its operative position in the magazine well 12 of an automatic-loading rifle 14 similar to the model M-16 rifle used by the armed forces of the United States of America. For the sake of clarity, parts of the rifle 14 are shown in phantom lines in FIGS. 1 and 2. The rifle 14 includes a barrel 16 having a firing chamber 18 with a breech opening 20 located at the rear end of the barrel 16. A breech bolt 22 is reciprocatingly movable between a rearward, or open, position in which the bolt 22 is located as shown in FIGS. 1 and 2, and a forwardlylocated, closed position in which the bolt 22 abuts against the rear end of the barre1 16, closing the breech opening 20 (FIG. 7). A bolt stop latch 24 is shown in FIG. 1 in a raised position, in which it is ahead of a portion of the front end 26 of the bolt 22, holding the bolt 22 in the open position.

A magazine 27, shown in broken line in FIG. 1, is held with its upper end within the magazine well 12 when the rifle 14 is loaded and is removable to permit rapid reloading of the rifle 14 by replacement of an emptied magazine 27 with a fully loaded one. However, when no magazine 27 is present in the magazine well 12 the bolt 22 and other moving parts are exposed within the magazine well 12. Thus, when the magazine 27 is removed as a safety precaution the internal parts of the action of the rifle 14 are susceptible to damage from abrasive dirt and to entry of particles which could lodge in the action of the rifle 14, causing malfunction.

The safety device 10, shown in greater detail and at an enlarged scale in FIGS. 4–6, includes a generally rectangular main body 28. The body 28 includes a right side 30, a left side 32, a front 34, and a rear side 36, and has a width 33, a length 35, and a height 37 of the portion of the body 28 within the magazine well 12. A rectangular spline 38 extends vertically along the rear side 36 of the body and includes an inclined surface or pad 40 at its upper end. The location of the pad 40 corresponds to that of a tab connected with a cartridge follower (not shown) of the magazine 27 when the rifle 14 is fully empty and the bolt 22 is open.

A top portion 42 having a width 44 narrower than the width 33 of the body 28 is located atop the main body 28 and extends above the height of the pad 40. The top portion 42 includes a generally vertical rear face 45.

The main body 28 and spline 38 fit slidably within the magazine well portion 12 of the rifle 14, occupying the space which normally is occupied by the upper portion of the magazine 27 when the rifle 14 is loaded. The size of the body 28 closely approximates that of the interior of the magazine well 12. The spline 38 is, for example, of the same width 44 as the top portion 42. The width 44 and a rearward distance 46 to which the spline 38 extends behind the rear side 36 are determined by the interior dimensions of the magazine well 12, so as to provide a sliding fit for the spline 38 within a cartridge follower channel provided in the rear portion of the magazine well 12 for movement of the tab of the cartridge follower (not shown) of the magazine 27. The spline 38 thus fills that channel to prevent entry of dirt when the safety device 10 is located operatively in the rifle 14. The magazine well 12 has an interior depth 47 (FIG. 1), the distance from its magazine-receiving opening to the location of the bolt 22 in the receiver portion of the rifle 14. The interior of the magazine well 12 similarly has an interior width 48 (FIG. 3) extending laterally of the rifle 14, and an interior length 49, extending longitudinally of the rifle 14.

Located along and extending laterally outward from the bottom of the right side 30 and left side 32 of the body 28 are a pair of flanges 50 and 52. In the safety device 10, designed for use particularly with an M-16 rifle, the flanges slope upwardly from the rear 36 to the front 34 of the main body 28, so that they tightly close the bottom of the magazine well 12. The flanges are thick enough (for example, being about 3/16 inch thick) to be clearly visible beneath the magazine well 12 when the safety device is in place, and to be used conveniently as a grip when removing the safety device 10 from the magazine well 12.

The bottom of the body 28 preferably defines a cavity 54 in order to minimize the weight of the safety device 10, without making it so weak that it can flex and thereby admit foreign matter into the magazine well 12. Similarly, an opening 56 extends laterally through the top portion 42, lightening the weight of the device 10 and also providing a place through which a strap or belt may be placed to attach the safety device 10 to a soldier's equipment pack.

When the safety device 10 is operatively in use in a rifle 14, as shown in FIG. 1, it is retained within the magazine well 12 by the magazine latch mechanism of the rifle 14. The magazine latch mechanism includes a push button 58, located on the right side of the rifle 14, and a push rod 60 (shown in FIG. 4) which is biased toward the right side of the rifle by a spring (not shown). A catch 62 extends forward along the left side of the rifle 14, as shown in FIG. 2, and ordinarily engages a detent (not shown) located on the left side of a magazine such as the magazine 27, to hold the magazine in place within the magazine well 12.

A detent 64 is located on the left side 32 of the main body 28 of the safety device 10. The detent 64 has a sloping upper surface which is inclined downwardly and outwardly with respect to the left side 32 of the safety device 10, as well as a generally horizontal bottom surface which extends outward from the left side 32 of the safety device. A depression 66 is located in the left side 32 immediately below the detent 64. Thus, as the safety device 10 is moved upwardly into the magazine well 12, the sloping surface of the detent 64, acting as a wedge, urges the catch 62 leftward. Once the safety device 10 has been fully inserted into the magazine well 12, the catch 62 is free to move rightwardly, urged by the spring, into a latching position beneath the detent 64 and partially within the depression 66, retaining the safety device 10 within the magazine well 12.

When the safety device 10 is located operatively within the magazine well 12, the flanges 50 and 52 abut closely against the bottom edges 68 and 70 of the left and right sides of the magazine well 12. Additionally, the front 34 of the safety device 10 is then located closely adjacent to a front interior surface of the magazine well 12, the spline 38 fills the cartridge follower channel at the rear of the magazine well, and the rear 36 of the safety device abuts against the rear interior surface of the magazine well 12, so that the safety device 10 effectively closes the magazine well 12 against entry of contaminants.

When the safety device 10 is properly located and held within the magazine well 12 by the catch 62, the top portion 42 extends upwardly between the front end 26 of the bolt 22 and the breech opening 20 of the barrel 16. The top portion 42 thus positively obstructs the bolt 22, the rear face 45 opposing the bolt 22, preventing it from being closed to make it possible to fire a cartridge from the rifle 14.

Additionally, when the safety device 10 is in place the pad 40 is located against the bottom of a bolt stop latch lever 72 of the rifle 14. The bolt stop latch lever 72 is ordinarily raised to an operative position by a portion of the cartridge follower (not shown) of a magazine 27 upon rearward movement of the bolt 22 after ejection of the final cartridge which was originally located within a magazine 27. Ordinarily, once the lever 72 has been raised by the cartridge follower of a magazine, the bolt stop latch 24 remains in a raised position, preventing forward movement of the bolt 22 until it is manually released after a loaded magazine 27 has been inserted into the proper location within the magazine well 12.

Since the pad 40 of the safety device 10 is located at the position which would be taken by a portion of the cartridge follower of a magazine 27 upon ejection of the final cartridge, it holds the lever 72 up, preventing the bolt 22 from being released to move forward while the safety device 10 is latched within the magazine well 12. Nevertheless, should the bolt stop latch 24 or the lever 72 become broken, the rear face 45 of the top portion 42 of the safety device 10 still prevents the bolt 22 from closing against the breech 20 of the barrel 16 and thus prevents the rifle 14 from discharging a cartridge, should such a cartridge be present in the chamber 18.

The rifle 14, as shown in FIG. 7, includes an empty case ejection port 74 and an ejection port cover 76, which is shown latched in a downwardly extending open position in FIG. 7. The ejection port cover 76 is attached to the right side of the rifle 14 by a hinge and is biased by a spring toward a closed position shown in broken line in FIG. 7, in which the ejection port cover 76 closes the ejection port 74 against entry of foreign material into the interior of the receiver of the rifle 14. Because of the construction of the rifle 14 it is difficult to visually determine, from any distance away from the rifle 14, whether the bolt 22 is closed or in a rearwardly-located open position, except by inspection with the ejection port cover 76 open. Keeping the ejection port cover 76 open, however, would permit airborne foreign matter to contaminate the moving parts located within the receiver of the rifle 14. Thus, keeping the ejection port cover 76 open increases the likelihood of the rifle 14 failing to operate properly at some later time.

The safety device 10 of the present invention may be fully inserted and latched into place within the magazine well 12 only when the bolt 22 is latched in its fully rearwardly located position by the bolt stop latch 24.

As shown in FIG. 7, the safety device 10 cannot be fully inserted and extends downwardly a noticeably greater distance below the bottom edges 68 and 70 of the magazine well 12, if the bolt 22 is closed when one attempts to insert the safety device 10. Since the magazine latch catch 62 engages the lug 64 only when the safety device 10 is fully inserted upwardly within the magazine well 12, the safety device 10 will normally fall out of the magazine well 12 unless it is fully inserted into the magazine well 12. Therefore, the safety device 10 cannot be inserted within the magazine well 12 to the proper location and will either be absent or visible to a much greater extent if the rifle 12 is in a condition to be fired immediately.

On the other hand, if the safety device 10 is properly located within the magazine well 12 of the rifle 14, the flanges 50 and 52 will be adjacent the bottom edges 68 and 70 of the magazine well 12, clearly visible to a person on either side of the rifle 14. Since the safety device 10 can be inserted fully into the weapon only when the bolt 22 is fully rearwardly withdrawn to the open position as shown in FIGS. 1 and 2, the presence of the flanges 50 and 52 closely along the bottom edges 68 and 70 verifies that the bolt 22 is fully rearwardly withdrawn, making it unnecessary for the ejection port cover 76 to be kept open. Furthermore, the top portion 42 prevents a cartridge from being placed into the chamber 18 through the ejection port 74.

Thus the flanges 50 and 52 and the spline 38 close the bottom opening of the magazine well 12 to prevent entry of contaminating materials such a sand and the like, and the ejection port cover 76 may be left closed to prevent entry of similar materials through the ejection port 74. Nevertheless, it is easy to verify visually, even from a considerable distance, that the rifle 14 has been made safe by the safety device 10 and cannot be fired unintentionally.

If it is desired, however, to fire the rifle 14 quickly, the safety device 10 can be quickly released from its location within the magazine well 12 by depressing the magazine latch release button 58 on the right side of the rifle 14. The safety device 10 is thus freed to drop or be withdrawn from the magazine well 12, permitting a loaded magazine 27 to be inserted in the normal manner.

The safety device 10 may be manufactured preferably of a durable high density plastics material with sufficient strength and thickness to prevent deformation which might permit dirt to enter the magazine well 12 around the safety device 10 and to prevent the bolt 22 from moving forward in case of failure of the bolt stop latch 24 to operate properly. Some resiliency of the material is preferred in order to provide a snug sliding fit in the magazine well and avoid damage to the moving parts such as the bolt 22 which may come into contact with the safety device 10. Preferably, the safety device 10 has a bright, clearly visible color, such as international orange, which contrasts with the color of the rifle 14, in order to facilitate verification from a distance of at least several meters that the safety device 10 is properly located within a magazine well 12.

A safety device 80 which embodies the present invention is generally similar to the safety device 10 in its functional characteristics. Instead of having a main body 28 which has flat right and left sides 30 and 32, however, the safety device 80 has a main body 82 including a centrally located wall 84, a right side rim 86, and a left side rim 88, which define a width 90, a length 92, and a height 94 of the main body 80, corresponding, respectively, with the width 33, length 35, and height 37 of the body 28. Whereas in the safety device 10 the bottom and interior of the body 28 are hollow, the right and left rims, 86, 88 of the body 82 of the safety device 80 define respective cavities in the sides of the body 82 in order to provide a main body 82 which is lighter than a solid body of the same overall dimension would be. The safety device 80 has an advantage with respect to the safety device 10 in that it is somewhat easier to manufacture as a molded plastic product.

Corresponding with the similarly-named portions and features of the safety device 10, the safety device 80 includes a front, a rear side 96, a spline 98, an inclined pad 100, a top portion 102, a top portion width 104, and a generally vertical rear face 105. The spline 98 extends behind the rear side 96 a rearward distance 106. A pair of flanges 108 and 110 are provided, and an opening 112 extends laterally through the top portion 102. A detent 114 corresponding to the detent 64 of the safety device 10 is also included.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. For use in a repeating firearm, said firearm having a bolt reciprocatingly movable between a closed position necessary for the firearm to be fired and an open position, and having a magazine well including an opening for receiving a magazine, a safety device for preventing the firearm from being fired, the safety device comprising:

(a) a main body capable of fitting within said magazine well; and (b) top portion means attached to said main body, for preventing said bolt from moving from the open position to the closed position when said main body is properly located within said magazine well, and for preventing said main body from being inserted fully into said magazine well when said bolt is in said closed position.

2. The safety device of claim 1, further comprising magazine well closure means, associated with said main body, for closing said opening into said magazine well and preventing entry of foreign material into said magazine well.

3. The safety device of claim 2 wherein said magazine well closure means comprises at least one flange extending from said body.

4. The safety device of claim 2 wherein a predetermined portion of said magazine well closure means is located outside said magazine well when said safety device is operatively located within said magazine well.

5. The safety device of claim 1 wherein said firearm further includes a magazine retention latch, said safety device further comprising detent means located on said main body for interacting with said magazine retention latch and retaining said safety device in an operative location with said main body located within said magazine well.

6. The safety device of claim 5, further including means defining a depression located on said main body for receiving a portion of said magazine retention latch of said firearm.

7. The safety device of claim 1, said firearm further including a bolt stop latch, said safety device further comprising pad means associated with said main body for causing said bolt stop latch to retain said bolt in an open position.

8. A safety device for use in conjunction with a firearm having a magazine well defining an exterior opening and having a predetermined interior width, a predetermined interior length and a predetermined depth, said firearm further having a firing chamber, a breech opening associated with said firing chamber, an ejection port equipped with a closable ejection port cover, and a bolt reciprocatingly movable between a breech closing position and an open position wherein said bolt is located a predetermined distance rearward from said breech closing position, said safety device comprising:

(a) a body having a width no greater than said predetermined interior width, a length no greater than said predetermined interior length, and a height at least equal to said predetermined depth;

(b) magazine well closing means connected with said body for closing said exterior opening against entry of foreign matter therethrough;

(c) a top portion connected with said body and including a generally vertical rearwardly facing surface separated from said magazine well closing means by a distance sufficiently greater than said predetermined depth, so that said vertical surface is interposed between said bolt and said breech opening when said safety device is operatively located in said firearm; and (d) means associated with said body for providing an indication, visually perceptible regardless of said ejection port cover being closed, that said firearm is not able to be fired when said safety device is operatively located in said firearm.

9. The safety device of claim 8, said firearm including a bolt stop latch for holding said bolt in said open position, said bolt stop latch including a bolt stop latch lever which holds said bolt stop latch in position to hold said bolt in said open position when said bolt stop latch lever is located in a predetermined bolt stop latch lever location, wherein said safety device further comprises a bolt latch lever holding pad associated with said body and located at a position, relative to said body, corresponding to said predetermined bolt latch lever location, for holding said bolt latch lever in said predetermined bolt stop latch lever location when said safety device is located operatively in said firearm.

10. The safety device of claim 8 wherein said body has a bottom and said magazine well closing means comprises a flange extending from said body at said bottom thereof.

11. The safety device of claim 8, said firearm further including a magazine retention latch mechanism having a movable catch for engaging a magazine within a magazine well, said safety device further comprising detent means for being engaged by said magazine retention latch mechanism for retaining said safety device located operatively in said firearm.

12. The safety device of claim 8 wherein at least a portion of said safety device is brightly colored and located so as to remain outside said firearm when said safety device is operatively located in said firearm.

13. The safety device of claim 8 wherein said top portion extends far enough from said main body to prevent full insertion of said safety device into said magazine well and thereby cause said body to extend outside said magazine well a clearly recognizable distance as an indication that said firearm is not in a safe condition when said bolt is in said breech closing position.

14. A safety device for use in a firearm of the type having a magazine well, said magazine well being of a predetermined size and including a cartridge follower channel and an exterior opening, the firearm further including a barrel having a breech, a bolt reciprocatingly movable, between a breech closing position and an open position in which the bolt is withdrawn rearwardly from the breech, a bolt stop latch capable of holding the bolt in said open position, and a magazine retention latch located at least partially within said magazine well, said safety device comprising:

(a) a main body which fits slidably within said magazine we11, said main body including front, rear, left, and right sides and a bottom;

(b) a flange extending laterally from each of said left and right sides of said main body adjacent said bottom;

(c) a spline extending vertically along said rear side of said main body and having a bolt stop latch operating pad located thereon;

(d) a top portion, including a rear face extending upwardly from said main body; and (e) a detent protruding outwardly from one of said sides of said main body, the location of said detent corresponding with the location of said magazine retention latch, and said flanges being so located relative to said detent as to close said exterior opening of said magazine well when said magazine retention latch engages said detent, and said pad being so located relative to said detent as to hold said bolt stop latch in a position engaging said bolt and holding it in said open position.

15. The safety device of claim 14 wherein said top portion extends upwardly from said body at least far enough to prevent said safety device from being inserted far enough into said magazine well for said detent to engage said magazine retention latch when said bolt is in a position closing said breech.

16. The safety device of claim 14 wherein said flanges and said main body are of a bright color.

* * * * *